United States Patent [19]

Dorbath et al.

[11] Patent Number: 4,487,664

[45] Date of Patent: Dec. 11, 1984

[54] METHOD AND ELECTROLYTIC BATH FOR THE DEPOSITION OF LOW CARAT BRIGHT GOLD-SILVER ALLOY COATINGS

[75] Inventors: Bernd Dorbath, Hanau; Rainer Schlodder, Rodenbach; Norbert Giesecke, Bruchkobel, all of Fed. Rep. of Germany

[73] Assignee: Degussa Aktiengesellschaft, Frankfurt, Fed. Rep. of Germany

[21] Appl. No.: 589,216

[22] Filed: Mar. 13, 1984

[30] Foreign Application Priority Data

Mar. 16, 1983 [DE] Fed. Rep. of Germany ..... 3309397

[51] Int. Cl.[3] ..... C25D 3/62; C25D 3/64

[52] U.S. Cl. ..... 204/44.3; 204/43.1

[58] Field of Search ..... 204/43.1, 44.3, 42.5, 204/46.1, 123

[56] References Cited

U.S. PATENT DOCUMENTS 4,121,982 10/1978 Moriarity ..... 204/44.3

FOREIGN PATENT DOCUMENTS 1213196 3/1966 Fed. Rep. of Germany ..... 204/44.3
629260 4/1982 Switzerland ..... 204/44.3
1283024 7/1972 United Kingdom ..... 204/43.1

*Primary Examiner*—G. L. Kaplan
*Attorney, Agent, or Firm*—Cushman, Darby & Cushman

[57] ABSTRACT

Bright, low carat gold-silver-alloy coatings which are ductile and have a thickness up to over 100 μm are obtained from an electrolytic bath containing 0.5 to 25 g/l of gold in the form of alkali gold cyanide, 0.25 to 15 g/l of silver in the form of alkali silver cyanide and 10 to 200 g/l of alkali cyanide as well as 0.001 to 5 g/l of tellurium in the form of a water soluble tellurium compound.

19 Claims, No Drawings

METHOD AND ELECTROLYTIC BATH FOR THE DEPOSITION OF LOW CARAT BRIGHT GOLD-SILVER ALLOY COATINGS

BACKGROUND OF THE INVENTION

The invention is directed to an electrolytic bath for depositing low carat, bright (glossy) gold-silver alloy coatings consisting essentially of (or consisting of) an aqueous solution of 0.5 to 25 g/l of gold in the form of alkali gold cyanide, 0.25 to 15 g/l of silver in the form of alkali silver cyanide and 10 to 200 g/l of alkali cyanide and an additive as hereinafter defined.

The electrolytic deposition of gold-silver alloy coatings has been known for many years. At current densities of 0.1 to 1 A/dm$^2$ thereby alloy layers having a content of 29 to 79% gold can be deposited. However, with decreasing gold content and increasing layer thickness the brittleness of the coating layer increases. Besides these coatings are not very bright.

By addition of organic materials and/or foreign metals which are not co-deposited to the electrolytes there can be deposited bright coatings. For example, there are known compounds of nickel, antimony, titanium, and indium as brightening imparting additives for electrolytic gold-silver baths. For example, there are known as organic brighteners triphenylmethane dyes (East German Pat. No. 98698) and condensation products of polyalkylenimines and alkylenepolyamines (German Pat. No. 2713507). In Swiss Pat. No. 629260 there is described as a brightening imparting additive a water soluble indium compound together with an organic aliphatic amine, in Moriarity U.S. Pat. No. 4,121,982 the combination of selenium containing compound and a polyethylenimine and in German Pat. No. 1213196 the combination of a selenium containing compound and a titanate ester stabilized with an aminoalcohol. All of these known brighteners, however, have the disadvantage that a satisfactory brightness can only be obtained up to layer thickness of about 25 μm and in a given case, organic materials are built into the layer. The brittleness of the coating cannot be reduced.

In the known gold-silver-alloy baths the gold content in the coating is substantially dependent upon the Au/Ag ratio in the bath and on the operating parameters chosen in the deposition, especially the current density and the bath temperature. These dependencies are disadvantageous for a practical bath operation for depositing low carat gold-silver alloys having constant carat content.

SUMMARY OF THE INVENTION

Therefore it was the problem of the present invention to provide an electrolytic bath for depositing low carat, bright (glossy) gold-silver-alloy coatings consisting of (or consisting essentially of) an aqueous solution of 0.5 to 25 g/l of gold in the form of alkali gold cyanide (e.g. potassium gold cyanide or sodium gold cyanide), 0.25 to 15 g/l of silver in the form of alkali silver cyanide (e.g. potassium silver cyanide or sodium silver cyanide) and 10 to 200 g/l of alkali cyanide (e.g. potassium cyanide or sodium cyanide) from which there can be deposited constant low carat layers substantially independent of the operating parameters such as current density and bath temperature and the gold-silver ratio in the bath which even in layer thicknesses above 25 μm, e.g. 50 μm or even 100 μm and above are bright and as ductile as possible.

This problem has been solved according to the invention by adding to the bath 0.0005 to 5 g/l of tellurium in the form of a water soluble tellurium compound. Preferably the electrolyte contains 0.001 to 1 g/l of tellurium in the form of a water soluble tellurium compound, whereby the tellurium can be present in the oxidation stage II, IV, or VI. Examples of such tellurium containing bath additives are tellurium dioxide ($TeO_2$), tellurium trioxide ($TeO_3$), tellurous acid and its derivatives such as tellurites, e.g. sodium tellurite and potassium tellurite, and higher condensed molecular complexes, telluric acid and its derivatives, e.g. sodium tellurate, ammonium tellurate, and potassium tellurate, tellurium-halogen compounds, e.g. tellurium tetrabromide, tellurium tetrachloride, tellurium dibromide, tellurium dichloride and tellurides, e.g. hydrogen telluride, sodium telluride and potassium telluride. The presence of tellurites and/or tellurates in the bath has proven best.

There are obtained from the baths of the invention outstandingly bright, brilliant gold-silver-alloy coatings which not only are distinguished by their brightness, but also their relative slight sensitivity to tarnishing and their ductility.

Besides by the addition of tellurium the known evident dependency of the alloy composition in the low carat Au/Ag alloy layer on the bath operating parameters such as current density, bath temperature and metal content is diminished considerably. With such a bath there is obtained a constant alloy composition in a substantially broader operating range. This effect above all is of especial advantage in the practical use of the bath.

For example, there is produced in a current density range of 0.6 to 1.2 A/dm$^2$ to one carat accuracy, 12-carat, bright gold-silver-alloy deposition. Even practice simulating deviations of other operating parameters such as temperature, pH, gold-, silver- and KCN content from the established bath operating conditions hardly change the composition and quality of the deposited alloy. For example, in the deposition of a lower carat gold-silver-alloy at a current density of about 0.9 A/dm$^2$, a bath temperature of 40° C. and a pH of 11.5, changing the bath temperature around ±5° C. or the pH between 10.5 and 12.5 does not change the composition of the deposited 12 carat alloy around more than ±1 carat.

Also it is possible to have relatively wide fluctuations in the concentration of the content of free KCN and $KAg(CN)_2$ without substantially changing the composition and quality of the low carat gold-silver-alloy. Thereby, however, the ratio of gold to silver as far as possible, should not exceed a value of 4:1 and should not be below a value of 1:2.

Besides these baths permit the production of low carat, bright gold-silver-alloy layers having layer thickness above 100 μm in a single deposition process without intermediate treatment. Also, the about 100 μm thick, low carat gold-silver-alloy layers still exhibit an outstanding brightness and a remarkably constant alloy composition over the entire layer thickness. Therefore such gold-silver-alloy baths are also suitable for the electroplastic production of 12–14 carat gold-silver-molded parts.

Customarily there is used a known electrolyte which contains gold, silver, and free potassium cyanide in aqueous solution and there is added to this a tellurium containing compound which is either soluble in water or reacts with water to form a soluble compound. Preferably, the bath is prepared with potassium salts, but there can also be used sodium salts or ammonium salt, or other reaction products of AuCN and AgCN with alkali cyanides. There have proven good baths which contain 5 to 10 g/l of gold in the form of potassium-gold cyanide, 1 to 6 g/l of silver in the form of potassium silver cyanide and 50 to 150 g/l of potassium cyanide.

For the production of the same effect different tellurium compounds require different concentrations. For example when adding $K_2TeO_3$5 to 30 mg/l is sufficient for a uniform deposition of a low carat gold-silver-alloy. In contrast using telluric acid to attain the same effect operation must be in the gram range, based on the telluric acid. Thereby the tellurium content of the bath can be supervised readily by analytical means.

By the addition of wetting agents, such as e.g. partially esterified forms of phosphoric acid the quality of the coating can be improved. Preferably there is used such wetting agent in the concentration range of 0.5 to 5 ml/l, e.g. compound I or compound II.

The bath is held at an alkaline pH, preferably between 10.5 to 12.5. The bath temperatures used are between 25° C. and 70° C. The higher the bath temperature the higher also is the necessary current density for the deposition of qualitatively trouble-free low carat Au/Ag alloys.

For example, there is obtained at a bath temperature of 40° C. in a current density range of 0.6 to 1.2 A/dm$^2$ a gold-silver-alloy of 12 carat ±1 carat. At a bath temperature of 70° C. there is obtained the same alloy composition in a current density range of 2.2 to 3.0 A/dm$^2$.

The composition can consist essentially of or consist of the stated materials.

The following examples set forth the characteristics of the bath of the invention in more detail.

I

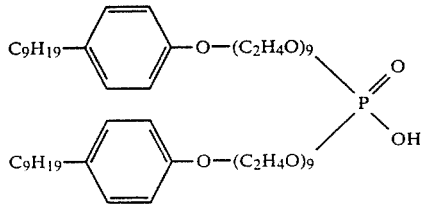

II

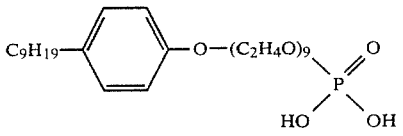

DETAILED DESCRIPTION

Example 1

There can be deposited from an aqueous electrolyte which has dissolved therein 9 g/l $KAu(CN)_2$, 4.5 g/l $KAg(CN)_2$, 1 ml/l of a mixture of phosphate esters of the condensation product of nonyl phenol and ethylene oxide containing 9 moles of ethylene oxide in each oxyethylene chain (a mixture of the compounds of formulas I and II) and 80 g/l KCN at 40° C. and pH 11 in the current density range of 0.6 to 1.0 A/dm$^2$ greenish-yellow matte, about 18 carat gold-silver-alloy coating. If there is added to this bath 20 mg/l $K_2TeO_3$ then under the same conditions in a current density range of 0.6 to 1.2 A/dm$^2$ bright, yellowish-white, about 12 carat gold-silver-alloy coatings are obtained.

Example 2

An aqueous electrolyte contained 3 g/l $KAu(CN)_2$, 1 g/l $KAg(CN)_2$, 20 g/l free KCN, 0.05 ml/l of a mixture of phosphate esters of the condensation product of nonly phenol and ethylene oxide containing 9 moles of ethylene oxide in each oxyethylene chain (a mixture of the compounds of formulas I and II) and 2 g/l telluric acid. At a pH of 11 and a bath temperature of 40° C. there is obtained at 0.6; 0.8; 1.0 A/dm$^2$ bright (glossy) about 12–14 carat gold-silver-alloy depositions.

Example 3

An aqueous electrolyte contained 10 g/l $KAg(CN)_2$, 15 g/l $KAu(CN)_2$, 200 g/l free KCN and 5 ml/l of a mixture of phosphate esters of the condensation product of nonly phenol and ethylene oxide containing 9 moles of ethylene oxide in each oxyethylene chain (a mixture of the compounds of formulas I and II). After addition of 4 g/l $TeCl_4$ there were produced between 2.2 and 3.0 A/dm$^2$ at pH 11 and a bath temperature of 70° C. bright, 10–14 carat gold-silver-alloy coatings.

Example 4

There can be deposited on a 1×2 cm size polished, nickel plated brass sheet from an electrolyte according to Example 1 at a current density of 1.0 A/dm$^2$ a 12 carat, bright, 100 μm thick gold-silver-alloy layer. At a pH of 11 and a bath temperature of 40° C. there is obtained the 100 μm thick bright Au/Ag layer without intermediate treatment.

What is claimed is:

1. An electrolytic bath suitable for the deposition of a low carat, bright gold-silver-alloy coating consisting essentially of an aqueous solution containing 0.5 to 25 g/l gold in the form of alkali gold cyanide, 0.25 to 15 g/l silver in the form of alkali silver cyanide, 10 to 200 g/l alkali cyanide and 0.0005 to 5 g/l tellurium in the form of a water soluble tellurium compound.

2. An electrolytic bath according to claim 1 which is alkaline.

3. An electrolytic bath according to claim 2 having a pH of 10.5 to 12.5.

4. An electrolytic bath according to claim 3 wherein the tellurium is present as a tellurite, a tellurate, or a mixture of a tellurite and a tellurate.

5. An electrolytic bath according to claim 4 containing a partially esterified phosphoric acid as a wetting agent.

6. A method of electroplating a bright gold-silver deposit having a carat value of not over 14 on a workpiece comprising subjecting the workpiece to the bath of claim 2.

7. A method according to claim 6 wherein the gold-silver deposit is electroplated to a thickness of at least about 100 μm.

8. A method according to claim 7 wherein the deposit has a carat value of 10 to 12.

9. A method according to claim 6 wherein the deposit has a carat value of 10 to 12.

10. An electrolytic bath according to claim 1 containing 0.001 to 1 g/l tellurium in the form of a water soluble tellurium compound.

11. A electrolytic bath according to claim 10 having a pH of 10.5 to 12.5.

12. An electrolytic bath according to claim 11 wherein the tellurium is present as a tellurite, a tellurate, or a mixture of a tellurite and a tellurate.

13. An electrolytic bath according to claim 12 containing $KAg(CN)_2$, $KAu(CN)_2$, KCN, and $K_2TeO_3$.

14. An electrolytic bath according to claim 12 containing a partially esterified phosphoric acid as a wetting agent.

15. An electrolytic bath according to claim 10 containing a partially esterified phosphoric acid as a wetting agent.

16. An electrolytic bath according to claim 1 wherein the tellurium is present as a tellurite, a tellurate, or a mixture of a tellurite and a tellurate.

17. An electrolytic bath according to claim 16 containing a partially esterified phosphoric acid as a wetting agent.

18. An electrolytic bath according to claim 1 containing a partially esterified phosphoric acid as a wetting agent.

19. A method of electroplating a bright gold-silver deposit having a carat value of not over 14 on a workpiece comprising subjecting the workpiece to the bath of claim 1.

* * * * *